United States Patent [19]

Simpson

[11] Patent Number: 4,824,154

[45] Date of Patent: Apr. 25, 1989

[54] SECURITY LOCK FOR DOUBLE-HUNG WINDOW

[75] Inventor: Harold Simpson, Hazel Crest, Ill.

[73] Assignee: Ashland Products Company, Chicago, Ill.

[21] Appl. No.: 154,656

[22] Filed: Feb. 10, 1988

[51] Int. Cl.[4] ..... E05C 17/44

[52] U.S. Cl. ..... 292/338; 292/67

[58] Field of Search ..... 292/338, DIG. 15, DIG. 20, 292/DIG. 33, DIG. 46, 67, 60; 49/406, 449

[56] References Cited

U.S. PATENT DOCUMENTS

| | | | |
|---|---|---|---|
| 534,185 | 2/1895 | Winchester | 292/DIG. 9 X |
| 1,077,487 | 11/1913 | Miller | 292/DIG. 20 X |
| 1,190,519 | 7/1916 | Creager et al. | 292/DIG. 46 X |
| 1,656,818 | 1/1928 | Dillon | 292/DIG. 20 X |
| 1,724,637 | 8/1929 | Bergstrom | 292/67 X |
| 2,610,849 | 9/1952 | Young | 49/449 X |
| 3,015,511 | 1/1962 | Sitterly | 292/DIG. 20 X |

FOREIGN PATENT DOCUMENTS

| | | | |
|---|---|---|---|
| 2225055 | 12/1972 | Fed. Rep. of Germany | 292/DIG. 20 |

*Primary Examiner*—Kenneth J. Dorner
*Assistant Examiner*—José V. Chen
*Attorney, Agent, or Firm*—Silverman, Cass, Singer & Winburn, Ltd.

[57] ABSTRACT

A security lock for a double-hung sash window assembly which is to be mounted on a stile of one of the sash frames to limit movement of the second sash frame relative to the one sash. The lock includes a casing adapted to be mounted within one of the sash frames, a faceplate of the casing having an opening therein communicating with an interior casing cavity. A tumbler pivots in the cavity and is spring biased to normally project through the opening to engage the second sash. A leaf spring is mounted within the casing cavity normally to bias the tumbler into its locking position, but permitting the tumbler to be retracted into the casing. The lock can be supplied as an assembled unit for installation.

6 Claims, 1 Drawing Sheet

SECURITY LOCK FOR DOUBLE-HUNG WINDOW

This invention relates generally to a manually operative lock for a window sash of a double-hung window assembly, and more particularly, to a novel lock constructed for easy and rapid assembly for installation as a unit on a window sash to prevent or limit movement of the second sash window.

BACKGROUND OF THE INVENTION

A double-hung window assembly includes a window frame and a pair of window sashes reciprocal vertically in guide rails of the master frame jamb of the window assembly. Although window sashes were traditionally made exclusively of wood, such window sashes can now be formed of extruded plastic frame members or metal frame members joined at mitred corners, for instance, to form a generally rectangular frame in which the glazing is mounted, as described in my U.S. Pat. No. 4,578,903.

U.S. Pat. No. 534,185 discloses a sash lock or fastener which, when the sash is closed, automatically locks and holds the sash in the closed position. The fastener includes a rectangular casing having an opening at its front end or faceplate in which opening a tumbler or dog is mounted, the casing being mortised into the upper sash and secured therein by screws. The tumbler is mounted within the casing by a guiding device so that the tumbler may be pivotally projected forward or longitudinally to overlie the lower sash and also to be moved laterally when projected forward to engage the casing and lock itself in position. The tumbler is biased in the projected position by a coiled, safety pin type spring mounted within the casing.

Sash security locks or fasteners similar to that disclosed in U.S. Pat. No. 534,185 are currently produced and still employ the safety pin type coil spring described hereinabove. It has been found that in the assembly of such sash locks, the coiled spring is unwieldy and difficult to properly position within the casing. Thus, these locks entail a labor expense factor in their installation attributable to the use of safety pin type springs.

The security lock embodying the invention utilizes a leaf spring which is designed to enable the lock to be assembled easily and rapidly for supply to the window manufacturer for installation. Thus, the supplier of the lock embodying the invention can provide this lock already assembled at reduced labor costs because the safety-pin type of spring is replaced.

SUMMARY OF THE INVENTION

A security lock for a double-hung sash window assembly including a pair of window sashes adapted for vertical reciprocal sliding movement relative to each other. The lock is designed to be installed in the stile of the upper sash frame and be opened to limit movement of the second or lower window sash. The lock includes a casing adapted to be mounted in a recess provided in the stile of one of the sash frames so that a faceplate of the casing projects only slightly forward of the stile's surface. The faceplate has an opening therein communicating with an interior cavity of the casing. A tumbler is designed to be positioned in the cavity to pivot between a retracted position and a locking position wherein an end of the tumbler projects through the opening to engage an exterior surface of the header of the second sash frame and prevent upward vertical movement thereof. The tumbler is spring-biased by a leaf spring to a normally protruding locking position and is movable to a retracted position in the casing. The leaf spring is designed to be quickly positioned within the casing so as to facilitate assembly of the lock.

BRIEF DESCRIPTION OF THE PREFERRED EMBODIMENT

Figure 1:
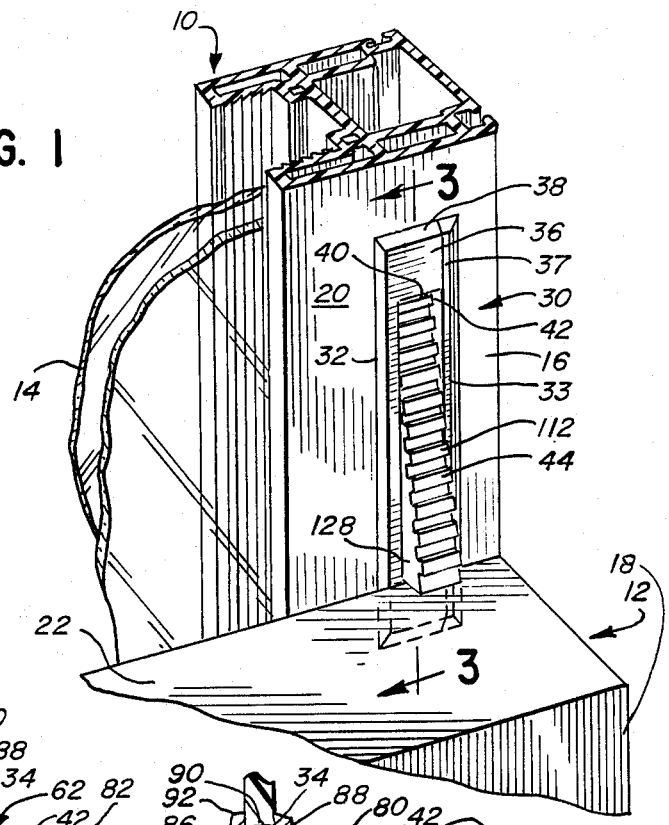
FIG. 1 is a fragmentary perspective view of a portion of a window sash assembly having the security lock embodying the invention installed in an upper window sash frame of the assembly.

Referring to the drawings, FIG. 1 illustrates partially a representative window of a so-called double-hung window sash assembly. Such an assembly includes a pair of double-hung upper and lower sashes designated 10 and 12 respectively and fitted with suitable glazing 14, such as shown with upper sash 10. The sashes 10 and 12 are mounted within a main jamb frame (not shown) for vertical slidable movement therein. The construction of the main jamb frame is not critical for achieving the advantages of this invention so that a description thereof was deemed unnecessary. Both the frame and the sashes 10 and 12 can be formed of different materials, such as metal or strong and rigid plastic materials well known in this field. The sashes 10 and 12 preferably are fabricated from elongate framing members of hollow configuration in cross-section for well known reasons of weight economy and thermal insulation advantages. Each sash 10, 12 is generally rectilinear in configuration, but for the purposes of describing the present invention, only the side member or stile 16 of the upper sash 10 and the upper or header member 18 of the lower sash 12 are relevant. The stile 16 has a front exterior surface 20 and the header 18 has an upper exterior surface 22.

Figure 2:
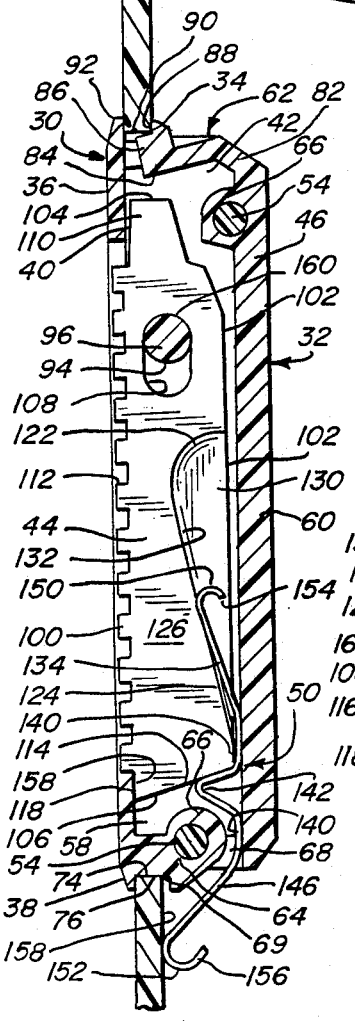
FIG. 2 is a fragmentary longitudinal sectional view taken through the installed lock embodying the invention but showing the lock in its retracted position; the view is similar to that of FIG. 3.
Figure 3:
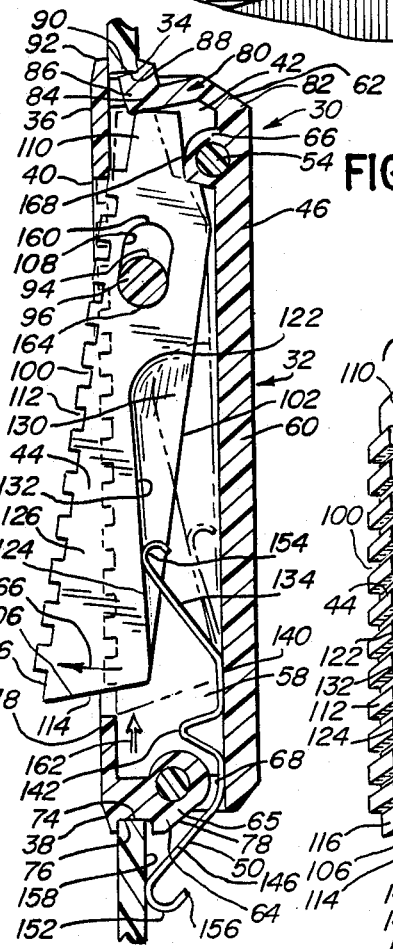
FIG. 3 is a sectional view taken along line 3—3 of FIG. 1 and in the direction indicated generally.

The lock of the invention is designated generally by the reference character 30 and is shown in FIG. 1 installed in the sash stile 16. The precise location of the lock 30 in the stile 16 will be determined by how much vertical movement of the sash 12 is desired before the header surface 22 will be intercepted by the lock 30 as described hereinbelow. The lock 30 includes a casing 32 which is designed to be installed in an opening 34 in the front surface 20 of the stile 16 as seen in FIGS. 2 and 3. The casing 32 has a front wall or faceplate 36 which overlaps the peripheral edge of the opening 34 to support the casing 32 therein and to provide an aesthetically pleasing appearance. The faceplate 36 includes portions 33 and 35 meeting along a vertical line 37 and is configured to project only slightly forward of the front surface 20 of the stile 16 so as to not interfere with the relative sliding movement of the sashes 10 and 12. To this end, the faceplate 36 may be provided with a beveled outer peripheral edge 38.

The faceplate 36 has a centrally located elongate vertical opening 40 which is in communication with an interior cavity 42 of the casing 32. An elongate tumbler 44 is mounted within the cavity 42 to pivot therein and to lockingly engage the upper surface 22 of the lower sash header 18.

Figure 4:
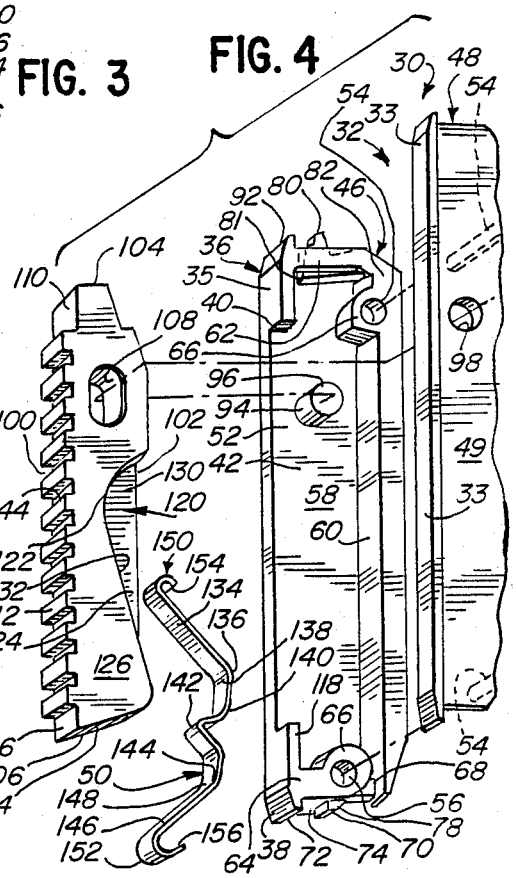
FIG. 4 is an exploded perspective view of the security lock embodying the invention.

Referring to FIG. 4, the lock 30 is shown in greater detail. For ease of assembly, the casing 32 is formed of two mating portions 46 and 48 which will be referred to as the housing portion and the cover portion respectively. The housing portion 46 is the larger of the two and defines the cavity 42 into which the tumbler 44 and the spring 50 are operatively located. The cover portion 48 includes the portion 33 of the faceplate 36 thereon and a wall 49 which serves as a cover for the otherwise open side 52 of the housing portion 46 and retains the tumbler 44 and spring 50 therein. The housing portion 46 includes the portion 35 of the faceplate 36. The cover portion 48 is attached to the housing portion 46 by at least one lug 54 which matingly engages a bore 56 in the housing portion 46.

The housing portion 46 includes a side wall 58 which opposes the wall 49, a back wall 60 which opposes the faceplate 36, a top wall 62 and a bottom wall 64. The portion 35 of the faceplate 36, the back wall 60, the top wall 62 and the bottom wall 64 are all integral with the side wall 58.

In the preferred embodiment, the back wall 60 and the bottom wall 64 are provided with thickened portions 66 integral therewith which extend into the cavity 42 and provide support to the casing 32 in the area of the bores 56. The bottom wall 64 is provided with a notch or passageway 68 between the thickened portion 66 and the inside face of the back wall 60. The purpose of the passageway 68 will be described in detail hereinbelow. The bottom wall 64 also has a depending wedge formation 70 which opposes a lower portion of the peripheral beveled edge 38 of the faceplate 36 and defines a channel 74 therebetween. The channel 74 engages an edge of 76 of the stile surface 20 defining the upper end of the opening 34 in the stile surface 20 to secure the casing 32 therein. To assist in the installation of the casing 32 within the opening 34, the wedge formation 70 has a tapered edge 78 which extends from the passageway 68 to the channel 74.

At the upper end of the casing 32, the top wall 62 is provided with an elongate spring clip 80 integral at one end 82 with the back wall 60 and provided at a free end 84 with a thickened portion 86 having a notch 88 as best seen in FIGS. 2 and 3. The clip 80 is located in an opening 81 in the top wall 62. The clip 80 is arranged so that the notch 88 engages an edge 90 of the stile surface 20 defining the lower end of the opening 34 and exerts a slight biasing force thereagainst to secure the casing 32 at its upper end within the opening 34. In effect, the edge 90 is sandwiched between the notch 88 and an upper portion 92 of the peripheral beveled edge 38.

The side wall 58 has a pivot lug 94 integral therewith located at an upper portion thereof near the top wall 62 and approximately equidistant from the faceplate 36 and the back wall 60. The lug 94 is positioned horizontally in the cavity 42 and at its free end 96 matingly engages an aperture 98 in the wall 49 of the cover portion 48 of the casing 32.

The tumbler 44 has a front edge 100, a rear edge 102, an upper end 104 and a lower end 106. An ovate transverse pivot bore 108 dimensioned to pivotally engage the lug 94 is located near the upper end 104 and approximately equidistant from the front edge 100 and the rear edge 102. The upper end 104 of the tumbler 44 is provided with a tapered formation 110 adapted to abut the top wall 62 of the casing 32 when the tumbler is in an extended or locked condition as shown in FIGS. 1 and 3. The front edge 100 of the tumbler 44 is provided with a finger button formation 112. The formation can assume anyone of many different configurations so long as it provides an enlarged finger grip as represented at 112. The lower end 106 of the tumbler 44 is provided with a tapered lower edge 114 which facilitates the pivoting motion of the tumbler 44 within the opening 40. In addition, the lower edge 114 intercepts the front edge 100 to form a depending portion 116 which is adapted to engage the faceplate 36 at a portion 118 near the lower end of the opening 40. The interaction between the depending portion 116 and the portion 118 locks the tumbler 44 in a retracted condition as seen in FIG. 2. The rear edge 102 has a substantially wedge shaped partial recess 120 therein which extends from just below the pivot bore 108 to the lower end 106 and tapers from an upper widened portion 122 near the pivot bore 93 to a narrowed portion 124 near the lower end 106. The recess 120 is open to a side 126 of the tumbler 44 but does not extend the entire width thereof to the opposite side 128 as best seen in FIG. 1. A wall portion 130 integral with the tumbler 44 and substantially flush with the side 128 defines the recess 120.

The recess 120 includes a wiping surface 132 for the spring 50. The spring 50 is a leaf spring formed of a flat elongate member and is substantially 'W'-shaped, having an upper arm 134 integral at one end 136 with a first end 138 of a center portion 140, the portion 140 having a wedgeshaped crease 142 cenetrally located thereon and a second end 144 integral with a lower arm 146 at one end 148 thereof. The free ends 150, 152 of both upper and lower arms 134, 146 are doubled over to form upper and lower hook formations 154, 156 respectively. The spring 50 is designed to facilitate assembly of the lock 30. To that end, the upper and lower arms 134, 146 are substantially identical, so that the spring 50 may be inverted during installation from the illustrated orientation and still be in proper operating position. Furthermore, the design of the recess 120 in the tumbler 44 and the passageway 68 in the casing 32 permit the spring 50 to be easily and accurately placed in its operating position.

Assembly of the lock 30 is accomplished by first placing the tumbler 44 into the cavity 42 of the housing portion 46 of the casing 32 so that the pivot bore 108 matingly engages the pivot lug 94. The spring 50 is then located near the bottom wall of the casing 32 between the rear edge 102 of the tumbler 44 and the rear wall 60 of the casing 32. As described previously, the spring 50 is designed so that either the upper arm 134 or the lower arm, 146 may engage the wiping surface 132. Upon proper positioning of the spring 50, the cover portion 48 of the casing 32 is snap-fit to the housing portion 46 by means of the mating lugs 54 and bores 56. The lock 30 is installed in the opening 34 of the stile 16 by first inserting the bottom wall 64 into the opening 34 so that the channel 74 engages the lower edge 76 of the opening 34. The top wall 62 is then inserted into the opening 34 until the end 88 of the spring clip member 80 snaps into engagement with the upper edge 90 of the opening 34.

Referring to FIG. 2, the spring 50 is positioned within the cavity 42 of the casing so that either hook information 154, 156 slidingly engages the wiping surface 132 of the recess 120. The spring 50 thus exerts a force against the tumbler 44 which biases the depending portion 116 of the lower end 106 thereof against the portion 118 of the faceplate 36. The tumbler 44 is thus maintained in an inoperative, retracted position. The spring 50 is positioned within the cavity 42 so that the wedge-shaped crease 142 engages the lower edge 114 of the tumbler 44 near the intersection thereof with the rear edge 102, the lower arm 146 projects through the passageway 68 to contact the inside surface 158 of the front surface 20 of the stile 16 and the center portion 140 is in contact with the back wall 60 of the casing 32.

When it is in the retracted position shown in FIG. 2, the tumbler 44 is positioned within the cavity 42 so that the ovate pivot bore 108 engages the pivot lug 94 at an upper end 160 of the bore 108. In addition, the upper tapered formation 110 of the tumbler 44 is not in contact with the upper wall 62 of the casing 32. The front edge 100 of the tumbler 44 is flush with the opening 40 in the faceplate 36 to facilitate the relative sliding action of the upper and lower sashes 10 and 12.

Referring to FIG. 3, when it is desired to lock the lower sash 12 to prevent upward sliding movement thereof, the tumbler 44 is actuated at the finger button formation 112 and is moved in an upward vertical direction indicated by the arrow 162. The upward movement of the tumbler 44 is terminated by the engagement of the pivot lug 94 with the lower end 164 of the ovate pivot bore 108, and further by the contact of the upper tapered formation 110 with the upper wall 62 of the casing 32. The tumbler 44 need only be moved vertically upward a sufficient distance to permit the depending portion 116 thereof to clear the portion 118 of the faceplate 36. Once the portion 116 is clear of the portion 118, the spring 50 urges the tumbler 44 forward through the opening 40 in the direction indicated by the arrow 166. The tumbler 44 will move in the direction 166 until the tapered end 110 intercepts the thickened portion 66, located near the top wall 62 of the casing 32 at a point 168. The tumbler 44 is easily retracted and locked within the opening 40 by reversing the above procedure.

Minor variations in the structure and in the arrangement and size of the various parts may occur to those skilled in the art without departing from the spirit and scope of the invention as set forth in the claims hereof.

I claim:

1. A security lock for use in a double-hung sash window assembly having upper and lower sash window frames formed of assembled header and hollow stile members and installed for vertical reciprocal sliding movement one relative to the other, a stile of said upper sash frame having a recess into the interior thereof from a side of the stile, and security lock comprising:

A. a casing having an internal cavity, a faceplate overlaying said cavity having an opening into the cavity and a pivot lug in the cavity secured to a wall of the casing , said casing adapted to be installed in said recess with the faceplate surrounding the perimetric edges of said recess;

B. a leaf spring having opposite ends and mounted in said cavity;

C. an elongated tumbler having an upper and lower ends with said upper end including pivot means pivotally mounting said tumbler on said lug in the casing and said lower end being movable between a locking position and a retracted position in the opening of the faceplate relative to the header of the lower sash frame;

D. said spring having one end engageable with the lower end of the tumbler normally to bias said lower end of the tumbler to protrude beyond said opening into said locking position to engage against the lower sash frame and prevent such relative sliding movement between the sash frames;

E. said pivotally mounted tumbler being retractable manually into the cavity to disengage said lower end of the tumbler from the lower sash frame header and permit such relative sliding movement between the sash frames;

F. said second end of the spring protruding from the casing into engagement with said side of the stile; and G. said lower end of the tumbler and faceplate and said pivot means having means cooperating to releasably maintain said lower end of the tumbler in said retracted position.

2. A security lock for use in a double-hung sash window assembly having upper and lower sash window frames formed of assembled header and hollow stile members and installed for vertical reciprocal sliding movement one relative to the other, a stile of said upper sash frame having a recess into the interior thereof from a side of the stile, said security lock comprising:

A. a casing having an internal cavity, a faceplate overlaying said cavity having an opening into the cavity and a pivot lug in the cavity secured to a wall of the casing, said casing adapted to be installed in said recess with the faceplate surrounding the perimetric edges of said recess;

B. a leaf spring having opposite ends and mounted in said cavity;

C. an elongated tumbler having upper and lower ends with said upper end pivotally mounted on said lug in the casing and said lower end being movable between a locking position and a retracted position in the opening of the faceplate relative to the header of the lower sash frame;

D. said spring having one end engageable with the lower end of the tumbler normally to bias said lower end of the tumbler to protrude beyond said opening into said locking position to engage against the lower sash frame and prevent such relative sliding movement between the sash frames;

E. said pivotally mounted tumbler being retractable manually into the cavity to disengage said lower end of the tumbler from the lower sash frame header and permit such relative sliding movement between the sash frames;

F. said second end of the spring protruding from the casing into engagement with said side of the stile; and G. said tumbler including a contoured recessed surface extending along the length of the tumbler, said one end of the spring being slidable along said recessed surface during pivotal movement of the tumbler between said locking and retracted positions.

3. The security lock as described in claim 2 in which said leaf spring is substantially W-shaped and said ends thereof have hook formations opening in the same direction, the hook formation of said one end having the bight thereof slidable along said surface.

4. The security lock according to claim 2 in which said tumbler has an enlarged bore through which the pivot lug is engaged.

5. A security lock for use in a double-hung sash window assembly having upper and lower sash window frames formed of assembled header and hollow stile members and installed for vertical reciprocal sliding movement one relative to the other, a stile of said upper sash frame having a recess into the interior thereof from a side of the stile, said security lock comprising:

A. a casing having an internal cavity, a faceplate overlaying said cavity having an opening into the cavity and a pivot lug in the cavity secured to a wall of the casing, said casing adapted to be installed in said recess with the faceplate surrounding the perimetric edges of said recess;

B. a leaf spring having opposite ends and mounted in said cavity;

C. an elongated tumbler having an upper and lower ends with said upper end pivotally mounted on said lug in the casing and said lower end being movable between a locking position and a retracted position in the opening of the faceplate relative to the header of the lower sash frame;

D. said spring having one end engageable with the lower end of the tumbler normally to bias said lower end of the tumbler to protrude beyond said opening into said lock position to engage against the lower sash frame and prevent such relative sliding movement between the sash frames;

E. said pivotally mounted tumbler being retractable manually into the cavity to disengage said lower end of the tumbler from the lower sash frame header and permit such relative sliding movement between the sash frames;

F. said second end of the spring protruding from the casing into engagement with said side of the stile; and G. said casing including a removable side wall adapted to provide an open side for the casing, said casing and said side wall having cooperating pin and socket securement means for releasably securing said side wall to the casing, said spring being mountable in the casing through the open side of the casing when said side wall is removed.

6. The security lock according to claim 5 in which said casing has means for engaging opposite edges of the stile recess for retaining the security lock installed in said stile recess.

* * * * *